US007664431B2

(12) United States Patent
Jang et al.

(10) Patent No.: US 7,664,431 B2
(45) Date of Patent: Feb. 16, 2010

(54) PHOTOCONDUCTIVE DRUM DRIVING GEAR DEVICE USABLE WITH IMAGE FORMING APPARATUS

(75) Inventors: Kyung-hwan Jang, Cheonan-si (KR); Joo-hwan Noh, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 259 days.

(21) Appl. No.: 11/237,781

(22) Filed: Sep. 29, 2005

(65) Prior Publication Data

US 2006/0078352 A1 Apr. 13, 2006

(30) Foreign Application Priority Data

Oct. 7, 2004 (KR) ..... 10-2004-0079784

(51) Int. Cl.
*G03G 15/00* (2006.01)

(52) U.S. Cl. ..... 399/167

(58) Field of Classification Search ..... 399/167; 464/62.1, 76, 110, 120, 66.1, 81, 160, 85; 74/411

See application file for complete search history.

(56) References Cited

U.S. PATENT DOCUMENTS

| | | | | |
|---|---|---|---|---|
| 2,071,885 | A * | 2/1937 | Lewis et. al. | 464/67.1 |
| 2,887,046 | A * | 5/1959 | Knops et. al. | 101/248 |
| RE26,356 | E * | 3/1968 | Pickles | 74/411 |
| 3,443,449 | A * | 5/1969 | Kotarski | 74/422 |
| 4,922,301 | A * | 5/1990 | Katoh et al. | 399/227 |
| 5,081,488 | A * | 1/1992 | Suzuki | 399/303 |
| 5,146,804 | A * | 9/1992 | Carmillet | 74/440 |
| 5,749,031 | A * | 5/1998 | Miwa et al. | 399/228 |
| 5,956,998 | A * | 9/1999 | Fenelon | 74/89.17 |

(Continued)

FOREIGN PATENT DOCUMENTS

| | | |
|---|---|---|
| JP | 04-269768 | 9/1992 |

(Continued)

OTHER PUBLICATIONS

Korean Office Action dated Mar. 15, 2006 of Korean Patent Application No. 10-2004-0079784.

*Primary Examiner*—David M Gray
*Assistant Examiner*—Andrew V Do
(74) *Attorney, Agent, or Firm*—Stanzione & Kim LLP

(57) ABSTRACT

A photoconductive drum driving gear usable with an image forming apparatus includes a driving shaft, a driving gear to rotate with the driving shaft in connection with the driving shaft and meshed with a photoconductive drum gear of a process cartridge of the image forming apparatus, and a connection unit to connect the driving gear and the driving shaft so that the driving gear rotates with respect to the driving shaft by a predetermined angle when mounting the process cartridge to a main body of the image forming apparatus. The connection unit includes a plurality of connection projections formed at one of the driving shaft and the driving gear, a plurality of connection recesses formed at the other one of the driving shaft and the driving gear to correspond with the connection projections and having a greater width than the connection projections, and an elastic member interposed between the connection projections and the connection recesses to elastically bias the driving gear in a certain direction with respect to the driving shaft.

12 Claims, 5 Drawing Sheets

U.S. PATENT DOCUMENTS 6,009,291 A 12/1999 Curry et al.
6,473,580 B1 * 10/2002 Inomata ..... 399/167
6,661,986 B2 * 12/2003 Kitayama ..... 399/167

FOREIGN PATENT DOCUMENTS

JP 09-112647 5/1997
JP 2001-51523 2/2001
KR 2002-0022681 3/2002

* cited by examiner

PHOTOCONDUCTIVE DRUM DRIVING GEAR DEVICE USABLE WITH IMAGE FORMING APPARATUS

CROSS-REFERENCE TO RELATED APPLICATIONS

This application claims the benefit under 35 U.S.C. §119 of Korean Patent Application No. 2004-79784, filed Oct. 7, 2004, in the Korean Intellectual Property Office, the disclosure of which is incorporated herein in its entirety by reference.

BACKGROUND OF THE INVENTION

1. Field of the Invention

The present general inventive concept relates to an image forming apparatus using a process cartridge, for example, a photocopier, a printer and a multi-function office machine, and more particularly, to a driving gear device to drive a photoconductive drum of the process cartridge.

2. Description of the Related Art

In a process cartridge, processing units, such as an electrifying device, a developing device and a cleaning device, are mounted together with a photoconductive medium as a cartridge to be detachably mounted into a main body of an electrophotographic image forming apparatus. Alternatively, the process cartridge may comprise the photoconductive medium together with at least one of the processing units, such as the electrifying device, the developing device and the cleaning device, as the cartridge for detachable connection to the main body of the electrophotographic image forming apparatus.

An image forming apparatus employing an electrophotographic process uses the process cartridge. Due to easy management and operation without requiring a dedicated skill, the image forming apparatus using the process cartridge has been widely spread.

FIG. 1 is a perspective view illustrating an exterior of a conventional process cartridge. A photoconductive drum 20 is rotatably supported at a cartridge frame 10 by a shaft 21. A photoconductive drum gear 22 is mounted on the shaft 21. Ends of the shaft 21 are protruded by a certain length out of the cartridge frame 10.

FIG. 2 is a view illustrating a connection between the photoconductive drum gear 22 of the conventional process cartridge mounted to a main body (not shown) of an image forming apparatus and a photoconductive drum driving gear 30 mounted to the main body (not shown).

A mounting rail 40 has a photoconductive drum center fixing part 41. By seating the shaft 21 in the photoconductive drum center fixing part 41, the process cartridge is mounted at a desired position in the main body of the image forming apparatus. The photoconductive drum driving gear 30 transmits power from a driving source (not shown) connected to the photoconductive drum driving gear 30 to the photoconductive drum gear 22 by meshing with the photoconductive drum gear 22.

FIG. 3 illustrates a conventional structure of the photoconductive drum driving gear 30. The photoconductive drum driving gear 30 rotates in connection with the driving source and, as shown in FIG. 2, is disposed at a certain angle (a) with respect to a vertical line C of the photoconductive drum center fixing part 41 to apply a force in a certain direction to the process cartridge when transmitting the power from the driving source to the photo conductive drum gear 22 of the process cartridge by meshing with the photoconductive drum gear 22.

When mounting the process cartridge into the image forming apparatus, the photoconductive drum driving gear 30 is at the certain angle (a) with respect to the vertical line C of the photoconductive drum center fixing part 41, and teeth of the photoconductive drum gear 22 mesh with teeth of the photoconductive drum driving gear 30. At this time, the photoconductive drum driving gear 30 is restrained from rotating due to connection with the driving source, such as a motor, and this may cause a problem in that the photoconductive drum gear 22 and the photoconductive drum driving gear 30 may not correctly mesh with each other. That is, the teeth of the photoconductive drum gear 22 and the teeth of the photoconductive drum driving gear 30 may not be properly aligned to mesh when the process cartridge is mounted into the image forming apparatus. Therefore, the teeth of the photoconductive drum gear 22 and the photoconductive drum driving gear 30 can be damaged, thereby deteriorating image quality in the image forming apparatus.

In addition, when the photoconductive drum gear 22 and the photoconductive drum driving gear 30 are incorrectly meshed, the photoconductive drum gear 22 and the photoconductive drum driving gear 30 may operate in a state in which the shaft 21 is deviated from the photoconductive drum center fixing part 41 of the mounting rail 40, as shown in FIG. 2. This may also considerably deteriorate the image quality, and the driving source may be applied with a load, thereby causing a malfunction of the image forming apparatus.

SUMMARY OF THE INVENTION

Accordingly, the present general inventive concept provides a photoconductive drum driving gear device that prevents inaccurate mounting of a process cartridge and damage to teeth of a photoconductive drum gear and a photoconductive drum driving gear.

The present general inventive concept also provides a driving gear device employable to transmit power in assorted electric and electronic appliances to prevent damage to teeth by absorbing an impact by a driven gear or an external impact.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a driving gear device comprising a driving shaft, a driving gear connected to the driving shaft to rotate with the driving shaft, and a connection unit to connect the driving gear and the driving shaft such that when an impact is applied to the driving gear with the driving shaft in a still state, the driving gear absorbs the impact by rotating by a predetermined angle with respect to the driving shaft.

The connection unit may comprise a plurality of connection projections formed at one of the driving shaft and the driving gear, a plurality of connection recesses formed at the other one of the driving shaft and the driving gear to correspond with the connection projections and having a greater width than the connection projections, and an elastic member to elastically bias the driving gear in a certain direction with respect to the driving shaft.

The elastic member may comprise a compressing coil spring interposed between at least one of the connection projections and at least one of the connection recesses.

The at least one connection recess may have a spring positioning projection part on a wall thereof, and the at least one connection projection may have a spring mounting part corresponding to the spring positioning projection part.

The driving gear device may further comprise four connection projections, four connection recesses and at least two compressing coil springs.

The foregoing and/or other aspects and advantages of the present general inventive concept are also achieved by providing a photoconductive drum driving gear device usable with an image forming apparatus, comprising a driving shaft, a driving gear to rotate with the driving shaft in connection with the driving shaft and meshed with a photoconductive drum gear of a process cartridge of the image forming apparatus, and a connection unit to connect the driving gear and the driving shaft such that the driving gear rotates with respect to the driving shaft by a predetermined angle when the process cartridge is mounted into a main body of the image forming apparatus.

The connection unit may comprise a plurality of connection projections formed at one of the driving shaft and the driving gear, a plurality of connection recesses formed at the other one of the driving shaft and the driving gear to correspond with the connection projections and having a greater width than the connection projections, and a spring interposed between at least one of the connection projections and at least one of the connection recesses to elastically bias the driving gear in a certain direction with respect to the driving shaft.

The connection unit may comprise four connection projections disposed at regular intervals of 90° at a driving gear connection part of the driving shaft, four connection recesses disposed at the driving gear to correspond to the connection projections, and two springs.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
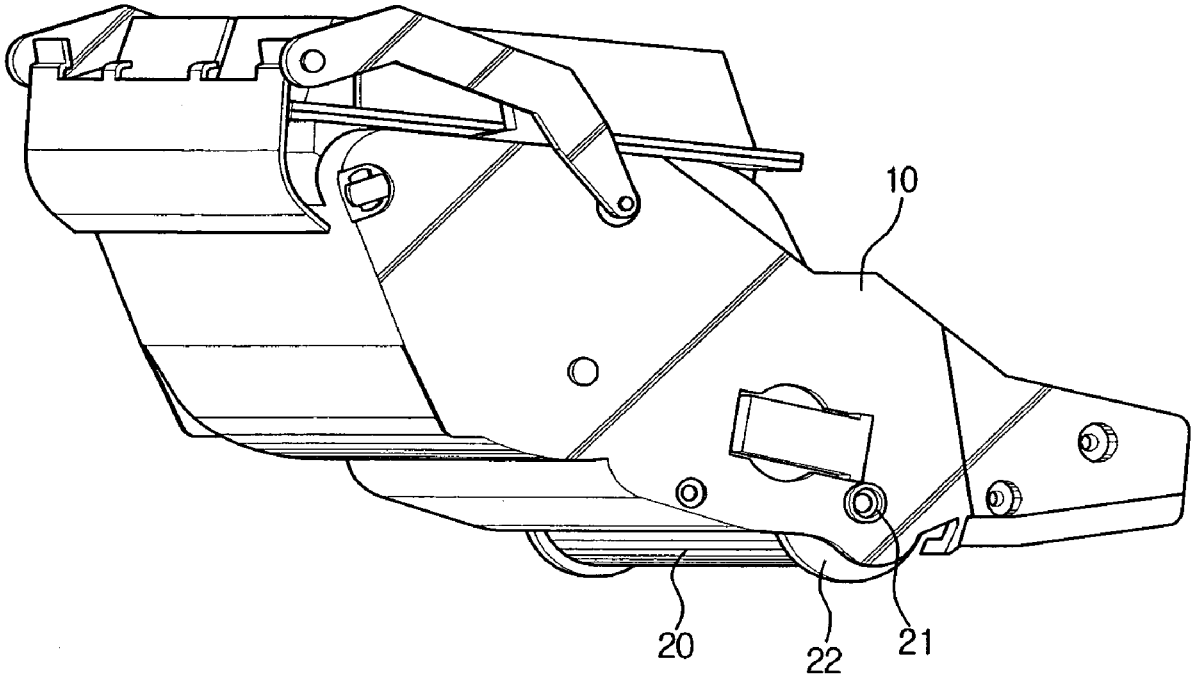
FIG. 1 (PRIOR ART)
FIG. 1 is a perspective view illustrating a process cartridge of a conventional image forming apparatus.

In the following description, like reference numerals are used for like elements even in different drawings. The matters defined in the description such as a detailed construction and elements are nothing but the ones provided to assist in a comprehensive understanding of the general inventive concept. Thus, it is apparent that the present general inventive concept can be carried out without those defined matters. Also, well-known functions or constructions are not described in detail since they would obscure the general inventive concept in unnecessary detail.

Figure 4:
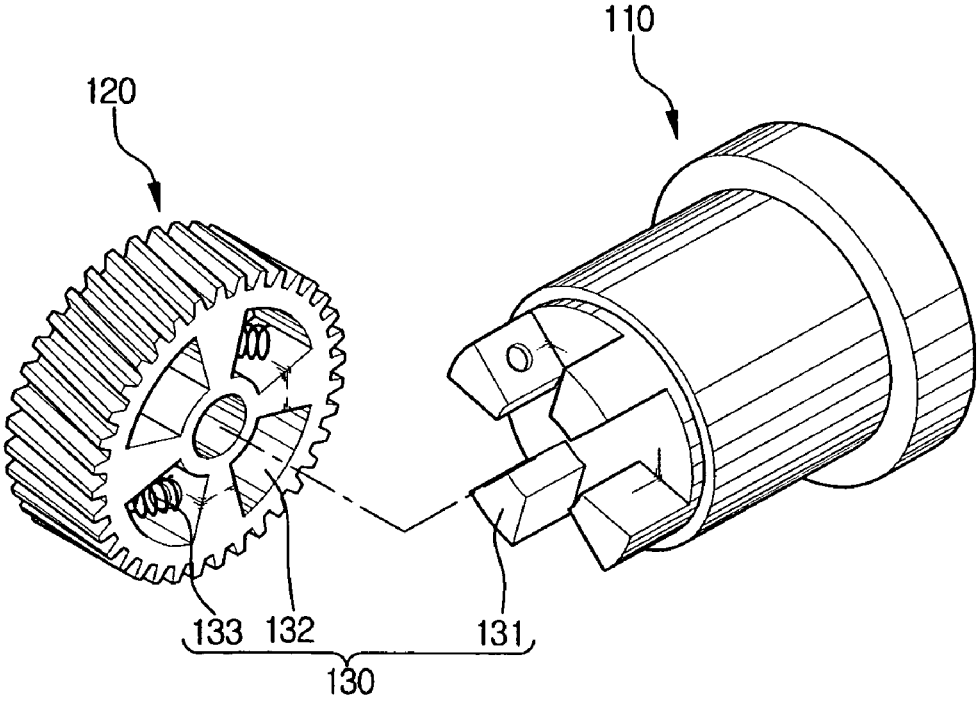
FIG. 4 is an exploded perspective view illustrating a structure of a photoconductive drum driving gear device according to an embodiment of the present general inventive concept.
Figure 5:
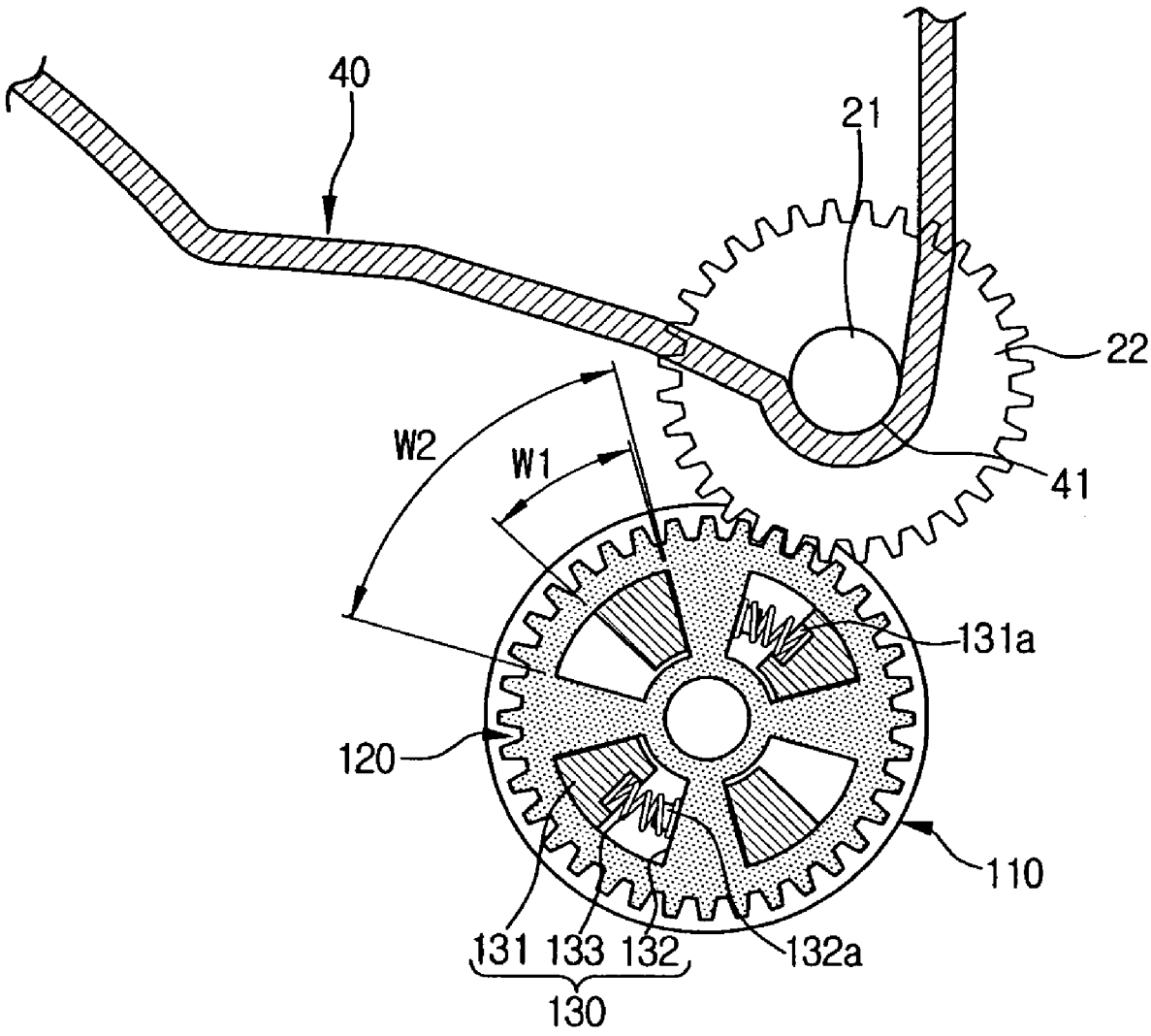
FIG. 5 is a view illustrating a meshing operation of a photoconductive drum gear of a process cartridge mounted in a main body of an image forming apparatus and a driving gear of the photoconductive drum driving gear device of FIG. 4, according to an embodiment of the present general inventive concept.

FIGS. 4 and 5 illustrate a photosensitive drum driving gear device according to an embodiment of the present general inventive concept. Referring to FIGS. 4 and 5, the photoconductive drum driving gear device comprises a driving shaft 110, a driving gear 120 and a connection unit 130. The photoconductive drum driving gear device can be mounted in a main body (not shown) of an image forming apparatus.

The driving shaft 110 rotates in connection with a driving source (not shown), such as a motor. The driving gear 120 is connected to the driving shaft 110 by the connection unit 130 and rotates together with the driving shaft 110.

The connection unit 130 connects the driving gear 120 and the driving shaft 110, so that the driving gear 120 rotates by a predetermined angle with respect to the driving shaft 110, and thereby absorbs an impact when the driving gear 120 is applied with the impact in a state in which the driving shaft 110 is still. For example, such an impact can occur when the driving gear 120 is impacted by a photoconductive drum gear 22 (FIG. 5) of a process cartridge during mounting of the process cartridge into the main body of the image forming apparatus.

Therefore, damage to teeth of the driving gear 120 and the photoconductive drum gear 22, which can occur by a collision of the photoconductive drum gear 22 and the driving gear 120 during the mounting of the process cartridge into the main body of the image forming apparatus, can be prevented. Furthermore, the image forming apparatus can be prevented from being driven with the photoconductive drum gear 22 and the photoconductive drum driving gear 120 being incorrectly meshed.

The connection unit 130 comprises a plurality of connection projections 131 formed at a driving gear connection part of the driving shaft 110, a plurality of connection recesses 132 formed at the driving gear 120 to correspond with the connection projections 131, and a plurality of elastic members 133 interposed between the connection projections 131 and the connection recesses 132 to elastically bias the driving gear 120 in a certain direction with respect to the driving shaft 110. That is, each of the elastic members 133 can be interposed between one of the connection projections 131 and an inner wall of one of the connection recesses 132 to elastically bias the connection projections 131 toward an opposing inner wall of the one of the connection recesses 132.

Figure 6:
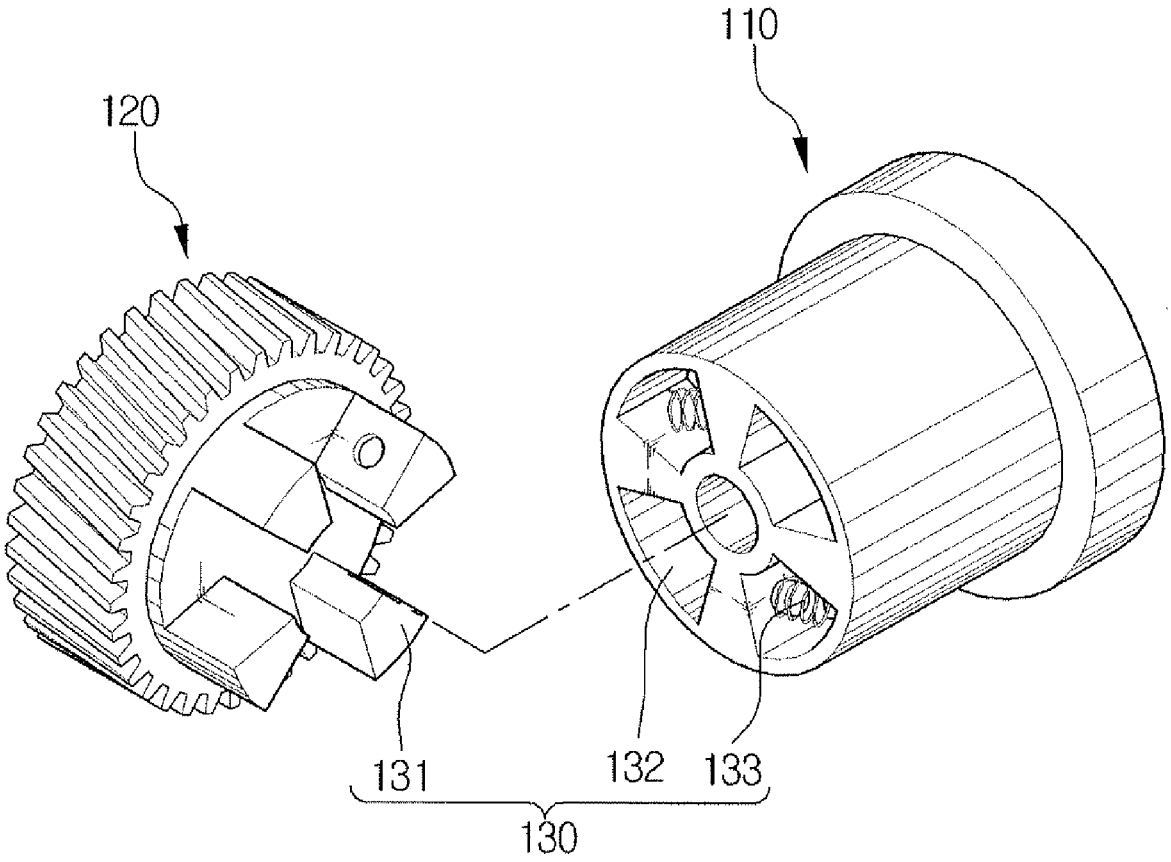
FIG. 6 is an exploded perspective view illustrating a structure of a photoconductive drum driving gear device according to another embodiment of the present general inventive concept.

Although the embodiment of FIGS. 4 and 5 illustrates an example where the connection projections 131 are provided at the driving shaft 110 and the connection recesses 132 are provided at the driving gear 120, the connection unit 130 is not limited thereto. For example, as illustrated in FIG.6, the connection projections 131 can be provided at the driving gear 120, and the connection recess 132 can be provided at the driving shaft 110.

In addition, although the numbers of the connection projections 131 and the connection recesses 132 are not limited, four connection projections 131 and four connection recesses 132 can be provided to provide rotational balance. The four connection projections 131 can be disposed at regular intervals of approximately 90°.

A width W2 (FIG. 5) of the connection recesses 132 is greater than a width W1 (FIG. 5) of the connection projections 131. The driving gear 120 can rotate with respect to the driving shaft 110 by a difference of the widths W1 and W2. That is, since the width W2 of the connection recesses 132 is greater than the width W1 of the connection projections 131, the connection projections 131 can move within the connection recesses 132 to allow the driving gear 120 to rotate with respect to the driving shaft 110 by a predetermined angle.

As shown in FIG. 5, the driving gear 120 can be elastically biased in a counterclockwise direction with respect to the driving shaft 110 by the elastic members 133. Accordingly, when being applied with the impact in a clockwise direction by the photoconductive drum gear 22 of the process cartridge, the driving gear 120 rotates in the clockwise direction while absorbing the impact, and allows the photoconductive drum gear 22 to smoothly mesh with the driving gear 120.

Figure 2:
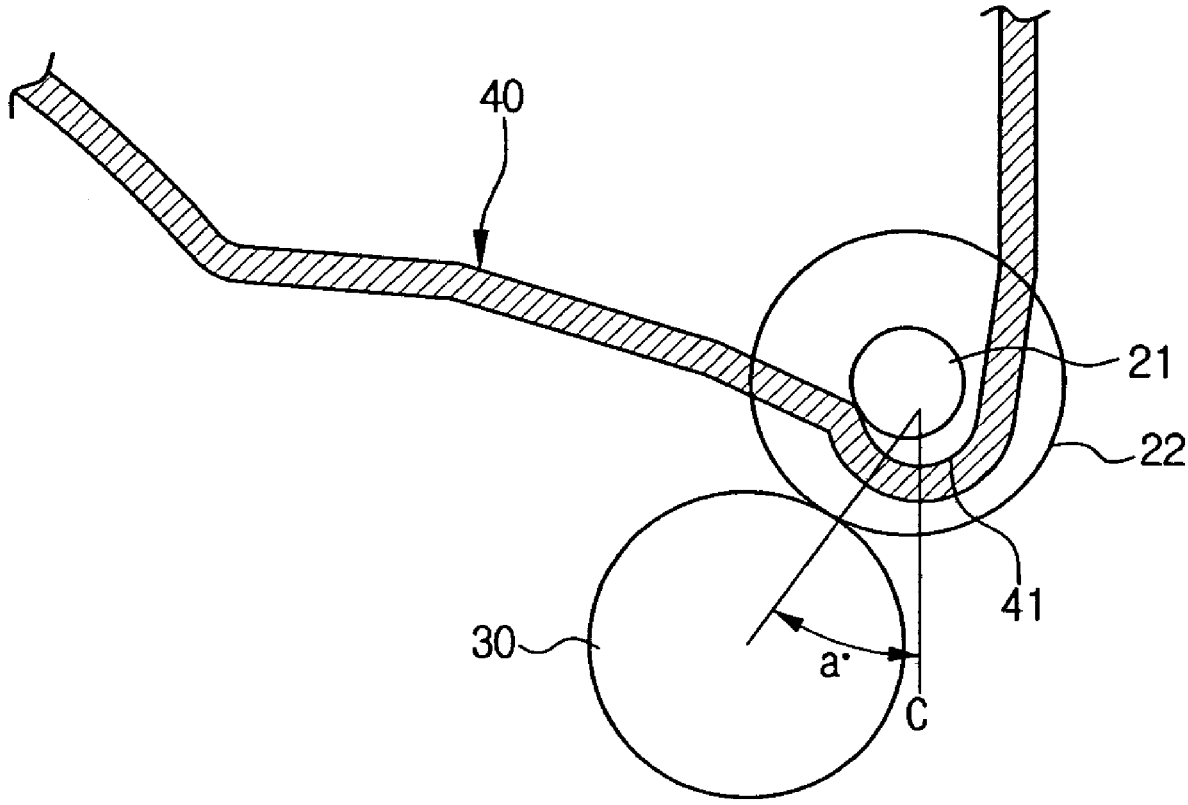
FIG. 2 (PRIOR ART)
FIG. 2 is a view illustrating a photoconductive drum gear and a photoconductive drum driving gear of the process cartridge of FIG. 1.
Figure 3:
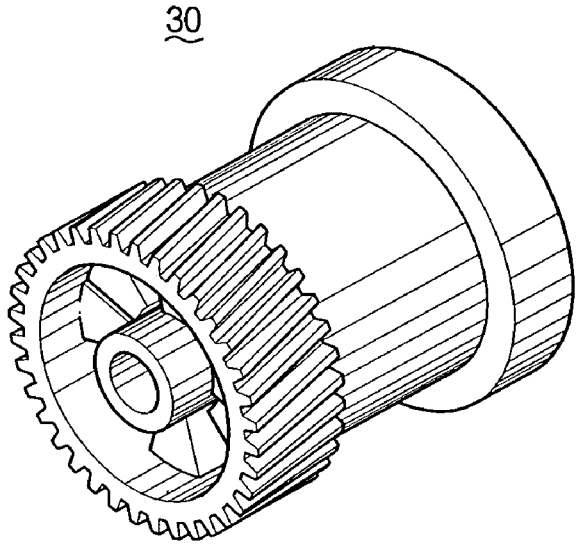
FIG. 3 (PRIOR ART)
FIG. 3 is a perspective view illustrating a conventional photoconductive drum driving gear.

In the conventional art, when the photoconductive drum driving gear 30 (FIG. 2) is not driven, collision of the teeth is often caused between the photoconductive drum driving gear 30 (FIG. 2) and the photoconductive drum gear 22 due to a restriction of rotation of the photoconductive drum driving gear 30. However, according to the embodiment of FIGS. 4 and 5, the driving gear 120 absorbs the impact caused by a collision of the teeth of the photoconductive drum gear 22 and the driving gear 120 by rotating with respect to the driving shaft 110 in a direction of the impact, thereby preventing damage to the teeth of the driving gear 120 and the photoconductive drum gear 22. Additionally, the teeth of the driving gear 120 and the photoconductive drum gear 22 can correctly mesh with each other when the driving gear 120 rotates with respect to the driving shaft 110 in the direction of the impact.

The elastic members 133 may each be formed of a compressing coil spring. A spring positioning projection part 132*a* to fix the compressing coil spring can be formed at a wall of one or more of the connection recesses 132. A spring mounting part 131*a* can be formed at one or more of the connection projections 131. Alternatively, positions of the spring positioning projection part 132*a* and the spring mounting part 131*a* can be exchanged. As an example, two elastic members 133, as well as two spring positioning projection parts 132*a* and two spring mounting parts 131*a* can be provided.

Hereinbelow, the operation of the photoconductive drum driving gear device of the image forming apparatus according to an embodiment of the present general inventive concept will be described in detail.

The photoconductive drum driving gear device is mounted in the main body (not shown) of the image forming apparatus. As shown in FIG. 5, the driving gear 120 is connected with the driving shaft 110 by the connection unit 130. Here, since the driving gear 120 is elastically biased by the elastic members 133 in the counterclockwise direction with respect to the driving shaft 110, the driving gear 120 is rotatable clockwise with respect to the driving shaft 110 by the predetermined angle.

The process cartridge is mounted into the main body of the image forming apparatus along a mounting rail 40, which is provided in the main body. A position of the process cartridge is determined by seating a photoconductive drum shaft 21 of the process cartridge in a photoconductive drum center fixing part 41 of the mounting rail 40.

During the mounting of the process cartridge, the photoconductive drum gear 22 formed at the process cartridge meshes with the photoconductive drum driving gear 120. Although the teeth of the photoconductive drum gear 22 and the driving gear 120 can collide with each other during the mounting of the process cartridge, the driving gear 120 can rotate clockwise with respect to the driving shaft 110 to absorb the impact from the collision, thereby decreasing damage to the teeth of the driving gear 120 and the photoconductive drum gear 22.

Moreover, as the driving gear 120 is rotated with respect to the driving shaft 110, the photoconductive gear 22 smoothly meshes with the driving gear 120.

A photoconductive drum driving gear device usable with an image forming apparatus has been illustrated and described so far. However, the photoconductive drum driving gear device according to an embodiment of the present general inventive concept can be used to transmit power not only in an image forming apparatus, but also in other assorted electric and electronic appliances to prevent damage of the teeth of gears.

According to an embodiment of the present general inventive concept as described above, when meshing a driving gear and a driven gear, for example, when meshing a photoconductive drum gear, which is the driven gear, and a driving gear of a photoconductive drum driving gear device while mounting a process cartridge into an image forming apparatus body, an impact from a collision of teeth of the driving and the driven gears can be absorbed by the driving gear rotating in a direction of the impact being applied. Therefore, damage to the teeth of the gears can be prevented.

Also, inaccurate mounting of a process cartridge can be prevented since a driving gear and a driven gear are well meshed.

As a result, image quality of a image forming apparatus can be improved by reducing teeth damage and inaccurate mounting of a process cartridge.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A photoconductive drum driving gear device usable with an image forming apparatus, comprising:

a driving shaft;

a driving gear to rotate with the driving shaft in connection with the driving shaft and removably meshed with a driven photoconductive drum gear of a process cartridge of the image forming apparatus; and a connection unit to connect the driving gear and the driving shaft such that the driving gear rotates with respect to the driving shaft by a predetermined angle when the driven drum gear impacts the driving gear as the driving gear and the driven drum gear collide and contact each other as the process cartridge is mounted into a main body of the image forming apparatus while the driving shaft is in a still state.

2. The photoconductive drum driving gear device of claim 1, wherein the connection unit comprises:

a plurality of connection projections formed at one of the driving shaft and the driving gear;

a plurality of connection recesses formed at the other one of the driving shaft and the driving gear to correspond with the connection projections and having a greater width than the connection projections; and at least one spring interposed between at least one of the plurality of connection projections and at least one of the plurality of connection recesses to elastically bias the driving gear in a certain direction with respect to the driving shaft.

3. The photoconductive drum driving gear device of claim 2, wherein the plurality of connection projections comprise four connection projections disposed at regular intervals of 90° at a driving gear connection part of the driving shaft, the plurality of connection recesses comprise four connection recesses disposed at the driving gear to correspond to the connection projections, and the at least one spring comprises two springs.

4. A driving gear device usable with an image forming apparatus to drive a driven gear of the image forming apparatus, comprising:

a driving shaft rotatably installed at a main body of the image forming apparatus; and a driving gear connected to the driving shaft to rotate with the driving shaft after rotating with respect to the driving shaft by a predetermined angle while the driving shaft is in a still state in response to a force caused by a collision with the driven gear of the image forming apparatus as the driving gear and the driven gear collide and contact each other.

5. The driving gear device of claim 4, wherein the driving gear rotates with respect to the driving shaft by the predetermined angle in a direction of the force caused by the collision with the gear of the image forming apparatus to engage with the gear of the image forming apparatus.

6. The driving gear device of claim 4, wherein one of the driving shaft and the driving gear comprises protruding portions, and the other one of the driving shaft and the driving gear comprise guide portions to accommodate the protruding portions and to allow the protruding portions to move within the guide portions to guide the rotation of the driving gear with respect to the driving shaft.

7. The driving gear device of claim 6, wherein a width of the accommodating portions is larger than a width of the protruding portions, and a difference between the widths of the accommodating portions and the protruding portions determines the predetermined angle.

8. The driving gear device of claim 7, wherein at least one of the guiding portions comprise an elastic member provided between an inner wall thereof and the respective protruding portion accommodated therein to elastically bias the protruding portion toward an opposite wall of the at least one of the guiding portions to prevent the driving gear from rotating when the force of a collision is not applied.

9. An image forming apparatus comprising:

a main body;

a process cartridge installable in the main body, and comprising a photoconductive drum and a driven photoconductive drum gear to rotate the photoconductive drum, the driven photoconductive drum gear being formed with teeth on a surface thereof;

a driving shaft installed in the main body to rotate with respect to the main body; and a driving gear connected to the driving shaft to rotate with the driving shaft, the driving gear formed with teeth on an outer surface thereof to align with the teeth of the driven photoconductive drum gear to transfer the rotation of the driving shaft to the driven photoconductive drum gear and rotatable with respect to the driving shaft at a predetermined angle to provide alignment between the teeth of the driven photoconductive drum gear and the teeth of the driving gear upon impact to the driving gear by the driven photoconductive drum gear before rotating with the drive shaft as the driving gear and the driven photoconductive drum gear collide and contact each other and while the driving shaft is in a still state.

10. The image forming apparatus of claim 9, wherein one of the driving shaft and the driving gear comprises protruding portions protruding from a surface thereof, and the other one of the driving shaft and the driving gear comprises accommodating portions to accommodate the protruding portions.

11. The image forming apparatus of claim 10, wherein a width of the accommodating portions is larger than a width of the protruding portions to allow the protruding portions to slide within the accommodating portions to guide the rotation of the driving gear with respect to the driving shaft.

12. The image forming apparatus of claim 11, wherein at least one of the accommodating portions comprises an elastic member interposed between an inner surface of the at least one of the accommodating portions and a wall of the protruding portion accommodated in the at least one accommodating portion to elastically bias the protruding portion toward an opposite wall of the at least one accommodating portion.

* * * * *